US009553365B2

(12) United States Patent
Lindenmeier et al.

(10) Patent No.: US 9,553,365 B2
(45) Date of Patent: Jan. 24, 2017

(54) MULTIBAND RECEPTION ANTENNA FOR THE COMBINED RECEPTION OF SATELLITE SIGNALS AND TERRESTRIALLY EMITTED RADIO SIGNALS

(75) Inventors: Stefan Lindenmeier, Gauting-Buchendorf (DE); Heinz Lindenmeier, Planegg (DE); Leopold Reiter, Gilching (DE); Jochen Hopf, Haar (DE)

(73) Assignee: DELPHI DEUTSCHLAND GMBH, Wuppertal (DE)

( * ) Notice: Subject to any disclaimer, the term of this patent is extended or adjusted under 35 U.S.C. 154(b) by 401 days.

(21) Appl. No.: 14/004,926

(22) PCT Filed: Mar. 15, 2012

(86) PCT No.: PCT/EP2012/001174

§ 371 (c)(1),
(2), (4) Date: Sep. 13, 2013

(87) PCT Pub. No.: WO2012/123125

PCT Pub. Date: Sep. 20, 2012

(65) Prior Publication Data

US 2014/0002319 A1 Jan. 2, 2014

(30) Foreign Application Priority Data

Mar. 15, 2011 (DE) ..... 10 2011 013 990
Feb. 22, 2012 (DE) ..... 10 2012 003 460

(51) Int. Cl.
*H01Q 5/00* (2015.01)
*H01Q 1/32* (2006.01)
(Continued)

(52) U.S. Cl.
CPC ..... *H01Q 5/0024* (2013.01); *H01Q 1/3275* (2013.01); *H01Q 5/30* (2015.01);
(Continued)

(58) Field of Classification Search
CPC ..... H01Q 5/0024
(Continued)

(56) References Cited

U.S. PATENT DOCUMENTS 7,295,167 B2 11/2007 Aminzadeh et al.
7,489,280 B2 2/2009 Aminzadeh et al.
(Continued)

FOREIGN PATENT DOCUMENTS

DE 10 2008 043 632 A1 5/2010
EP 0 989 629 A1 3/2000
(Continued)

OTHER PUBLICATIONS

International Search Report dated Jun. 29, 2012.

*Primary Examiner* — Dameon E Levi
*Assistant Examiner* — Walter Davis

(57) ABSTRACT

A multiband reception antenna enables the combined reception of circularly polarized satellite radio signals from at least one satellite radio service which emits with circular polarization and of terrestrially emitted radio signals. The multiband reception antenna comprises at least one satellite reception antenna with a ring line emitter and a plurality of vertical emitters are connected to the ring line emitter over the circumference of the ring line emitter. Furthermore, a monopole is provided, with a monopole connection point formed at the lower end thereof.

16 Claims, 9 Drawing Sheets

(51) Int. Cl.

| | |
|---|---|
| ***H01Q 7/00*** | (2006.01) |
| ***H01Q 9/36*** | (2006.01) |
| ***H01Q 5/30*** | (2015.01) |
| ***H01Q 5/40*** | (2015.01) |

(52) U.S. Cl.
CPC ..... *H01Q 5/40* (2015.01); *H01Q 7/00* (2013.01); *H01Q 9/36* (2013.01)

(58) Field of Classification Search
USPC ..... 343/725
See application file for complete search history.

(56) References Cited

U.S. PATENT DOCUMENTS

| | | | | |
|---|---|---|---|---|
| 7,936,309 | B2 * | 5/2011 | Lindenmeier ..... | H01Q 1/3275 343/725 |
| 2003/0174098 | A1 | 9/2003 | Noro et al. | |
| 2004/0183737 | A1 * | 9/2004 | Lindenmeier ..... | H01Q 1/521 343/725 |
| 2004/0196203 | A1 * | 10/2004 | Lier ..... | H01Q 1/081 343/824 |
| 2010/0253587 | A1 | 10/2010 | Lindenmeier et al. | |
| 2011/0221640 | A1 | 9/2011 | Huber | |

FOREIGN PATENT DOCUMENTS

| | | | |
|---|---|---|---|
| EP | 1 619 752 | A1 | 1/2006 |
| EP | 2 226 895 | A2 | 9/2010 |

* cited by examiner 22
18
17,25
3a
13
19
21
M
23
17,26
17

MULTIBAND RECEPTION ANTENNA FOR THE COMBINED RECEPTION OF SATELLITE SIGNALS AND TERRESTRIALLY EMITTED RADIO SIGNALS

CROSS-REFERENCE TO RELATED APPLICATIONS

This application is a National Stage of International Application No. PCT/EP2012/001174, filed on Mar. 15, 2012. The entire disclosure of the application referenced above is incorporated herein by reference.

TECHNICAL FIELD OF THE INVENTION

The invention relates to a multiband receiving antenna 1 for the combined reception of circularly polarized satellite radio signals of at least one satellite radio service transmitting in a circularly polarized manner and of terrestrially transmitted radio broadcast signals via a substantially horizontally conducting base surface 6 as a ground, comprising at least one satellite receiving antenna 3 having a satellite antenna connection 5, the at least one satellite receiving antenna being associated with the at least one satellite radio service having the transmission frequency fs1 and a monopole antenna having a specific monopole connection point 14 receiving terrestrial radio broadcast signals transmitted in a linearly polarized manner.

BACKGROUND OF THE INVENTION

Terrestrially transmitted radio broadcast signals of radio broadcasts are transmitted in the frequency ranges of the radio broadcasting bands AM and FM by means of electromagnetic waves whose wavelengths are not shorter than approximately 2 m. New developments with rod-shaped active antennas attached perpendicular to the vehicle body acting as a conducting base surface for the two said broadcasting bands have led to smaller antenna lengths of approximately 20 cm. However, in the construction of vehicles frequently a further reduction in length of such antennas is required.

Due to the narrow construction spaces, the substantial requirement exists with regard to vehicle antennas to minimize their smallness and, in particular to thereafter minimize the outline of the antenna. In particular for satellite radio services as a first radio service the combination of satellite antennas and antennas for other radio services in a narrow space is problematic due to the coupling of radiation between the antennas and the deformation of the directional pattern of the satellite antenna associated therewith. This is, in particular founded on the tightly dimensioned link budget which can lead to a failure of the radio connection due to a drastic deformation of the directional pattern. For example, for satellite antennas in accordance with the standard of satellite radio transmission SDARS in the elevation angular range, e.g. between 25 and/or 30 degrees and 60 and/or 90 degrees an antenna gain of constantly e.g. 2 dBi and/or 3 dBi for circular polarization is strongly required, in dependence on the operator. This requirement exists for an antenna assembled in a center of a planar conductive base plate. This requirement can then only be maintained when the deviation from the ideal radiation characteristic for no spatial angle amounts to more than 0.5 dB. Thus, the directional pattern, in particular in view of the dimension known for antennas of vehicles, has an extremely narrow tolerance. In the DE 101 08 910, e.g. the constructional shape of an antenna is provided which enables the maintenance of the narrowly tolerated directional pattern. With antennas of this type the antenna gain required in the region of the zenith angle can generally be realized without a problem. For this antenna, the reception of terrestrially transmitted signals according to the SDARDS standard are combined with a monopole antenna, whereby a smaller design of the combined antenna advantageous with regard to the use at vehicles results for the first radio service 1. A requirement of narrow tolerance is to be substantially maintained in a corresponding manner for the assembly at a vehicle. Beside this satellite radio broadcast service also further satellite radio services should be possible, such as e.g. the Global Positioning System (GPS).

An antenna according to the state of the art is provided in the DE 101 08 910, it is, however, in no way suitable to receive terrestrially transmitted broadcast signals of radio broadcasts in the frequency ranges of the AM radio bands having free space wavelengths between 600 m and 10 m, as well as the FM radio bands with approximately 3 m free space wavelengths due to its small height.

SUMMARY OF THE INVENTION

For this reason it is the object of the present invention to provide a multiband antenna having a particularly small outline and a particularly small height for the combined reception of circularly polarized satellite radio signals of at least one satellite radio service transmitting in a circularly polarized manner and of terrestrially transmitted radio broadcast signals in the radio broadcasting bands AM and FM. Furthermore, the possibility should exist to utilize terrestrial radio services of higher frequencies such as e.g. DAB VHF, GMS900, GSM 1800, UMTS and DAB L band.

Measures for the design of an antenna for further radio services arranged or attached in the vicinity of a first antenna for a first radio service having a directional pattern with a narrow tolerance are provided, which antenna avoids the disadvantages of the deformation of the antenna directional pattern of the antenna for the first radio service.

This object is satisfied by an antenna in accordance with the preamble of the independent claim by the characterizing features.

These features are:

- the at least one satellite receiving antenna 3 includes a ring line radiator 2 which is rotationally symmetric with respect to its center Z, which ring line radiator is configured by a polygonal or circular closed ring guide having the extended length L smaller than the free space wave length λ running in a plane parallel with respect to the conducting base surface 6 and having a spacing 9 smaller than λ/8 over the conducting base surface 6,
- a plurality of N vertical radiators 4 running towards the conducting base surface 6 are connected via ring line connection points 7 to the ring line radiator 2 over the circumference of the length L of the ring line radiator 2 of the satellite receiving antenna 3 in equal length extended length spacings L/N of the structure separate from one another;
- the ring line radiator 2 is excited via at least one of the vertical radiators 4 between whose lower end and the conducting base surface 6 the satellite antenna connection 5 is formed, in particular via a capacitor 15*d*, with the at least one satellite receiving antenna 3 being circularly polarized;

the remaining vertical radiators 4 are respectively connected at their lower ends at a ground connection point 11 to the conducting base surface 6 via a capacitor 15*a*, 15*b*, 15*c;* the monopole antenna 13 includes a substantially rod-shaped monopole 13 oriented vertical with respect to the conducting base surface 6 and extending through the center Z of the ring line radiator 2, the monopole connection point 14 for the decoupling of the radio broadcast signals transmitted in a linearly polarized manner being formed at the lower end of the rod-shaped monopole 13 together with the conducting base surface 6;

a substantially periodic conductor structure 24 having a period 19 and an oscillation width 18 is conductively connected to the upper end of the rod-shaped monopole 13 for forming a roof capacitor 8, said periodic conductor structure being formed from an, in particular wire shaped, conductor 17 and expanding in an oscillating manner about a substantially horizontally oriented longitudinal middle line M; both the period 19 and the oscillation width 18 are each selected smaller than half the free space wavelength λs1 of said satellite radio service having the highest transmission frequency fs1.

A satellite antenna 3 in accordance with the invention is associated with the advantage that the design in accordance with the invention of a roof capacitor 8 of a vertical rod-shaped monopole 13 present in the center of the satellite antenna practically does not influence the narrowly tolerated directional pattern of the satellite antenna 3 for a design in accordance with the invention. In this manner it is possible to receive the terrestrially transmitted radio broadcast signals in the AM and FM frequency ranges with an extremely low constructional height 29 of the multiband-receiving antenna 1.

This requirement is in particular raised for car antennas, wherein, due to the rotation of the electric fields in the FM frequency range, brought about by the vehicle body, the reception takes place with vertical polarization, this means with the vertically oriented rod-shaped monopole 13. The frequently requested requirement of a combined antenna with a constructional height of merely approximately 7 cm can be satisfied by the design of a sufficiently large roof capacitor. By means of the design of the roof capacitor 8 in accordance with the invention in the shape of a conductor structure 24 having the period 19 and the oscillation width 18 and oscillating in an expanding manner about a longitudinal middle line M, in particular the azimuthal directional pattern of the satellite antenna 3, in accordance with the invention is practically influenced also for relatively large longitudinal extents of the periodic conductor structure 24. The additional requirement is frequently raised in the construction of vehicles, according to which the transverse dimensions of the antenna are subjected to stringent requirements. Thus the roof capacitor 8 can no longer be of rotationally symmetric design. This leads to the request that the ratio of longitudinal extent to transverse extent of the roof capacitor can be selected as at least 3:1 up to the ratio of 8:1. The required azimuthal omnidirectional pattern of the satellite antenna cannot be achieved with a roof capacitor designed in an aerially conducting manner. In contrast to this, with the aid of the combination of the satellite antenna 3 in accordance with the invention having the rod-shaped monopole 13 and the design of the roof capacitor 8 in accordance with the invention satisfies this problem advantageously also from an economic point of view.

It can be advantageous when the ring line radiator forms a resonant structure, wherein, in the transmission case, the current distribution of a running conductive wave is set in a single direction of revolution at the ring guide whose phase difference over a period amounts to a whole numbered multiple of the phase angle 2Π.

Moreover, the arrangement can alternatively be configured in such a way that a distribution and phase network is present at the conducting base surface which is connected to the satellite antenna connection at the input side such that the vertical radiators are each excited via one of the outputs of the distribution and phase network with corresponding phases, such that a running electromagnetic wave is set at the ring line radiator in such a way that the circular polarization of the satellite receiving antenna is provided as is disclosed in the FIGS. 1*a* and 1*b* of the US 2003/0063038.

BRIEF DESCRIPTION OF THE DRAWINGS

The invention will be described in detail with reference to embodiments. The associated Figures individually show.

Figure 1:
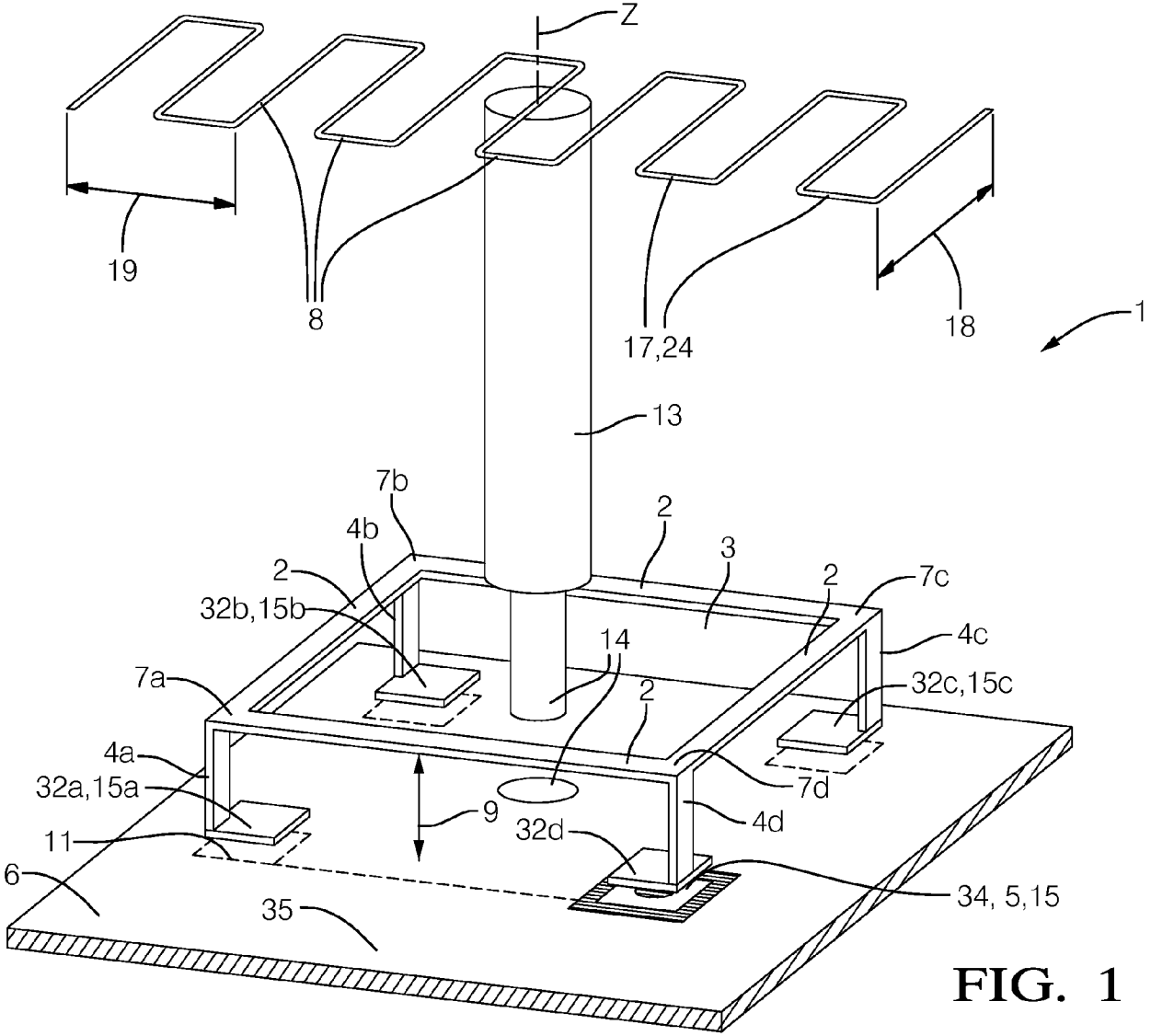
FIG. 1

A multiband-receiving antenna 1 in accordance with the invention having a satellite receiving antenna 3 with a rotationally symmetric ring line radiator 2 and vertical radiators 4 extending towards the conducting base surface 6 and a satellite antenna connection 5 combined with the rod-shaped monopole 13 having a roof capacitor 8 in the shape of a meandering structure 25 of a wire-like conductor 17,

FIG. 2

A multiband-receiving antenna 1 in accordance with the invention like in FIG. 1, however, having a rod-shaped monopole 13 whose self-inductance is increased by a substantially cylindrical wire coil 35 which is wound onto a rod-shaped dielectric body.

FIG. 3*a*

A periodic conductor structure of the roof capacitor 8 as a periodic meandering structure having the period 19 in accordance with the invention designed within a virtual strip 21. The rod-shaped monopole 13 is conductively connected to the periodic conductor structure 24.

FIG. 3*b*

Figures 3A, 3B, 3C:
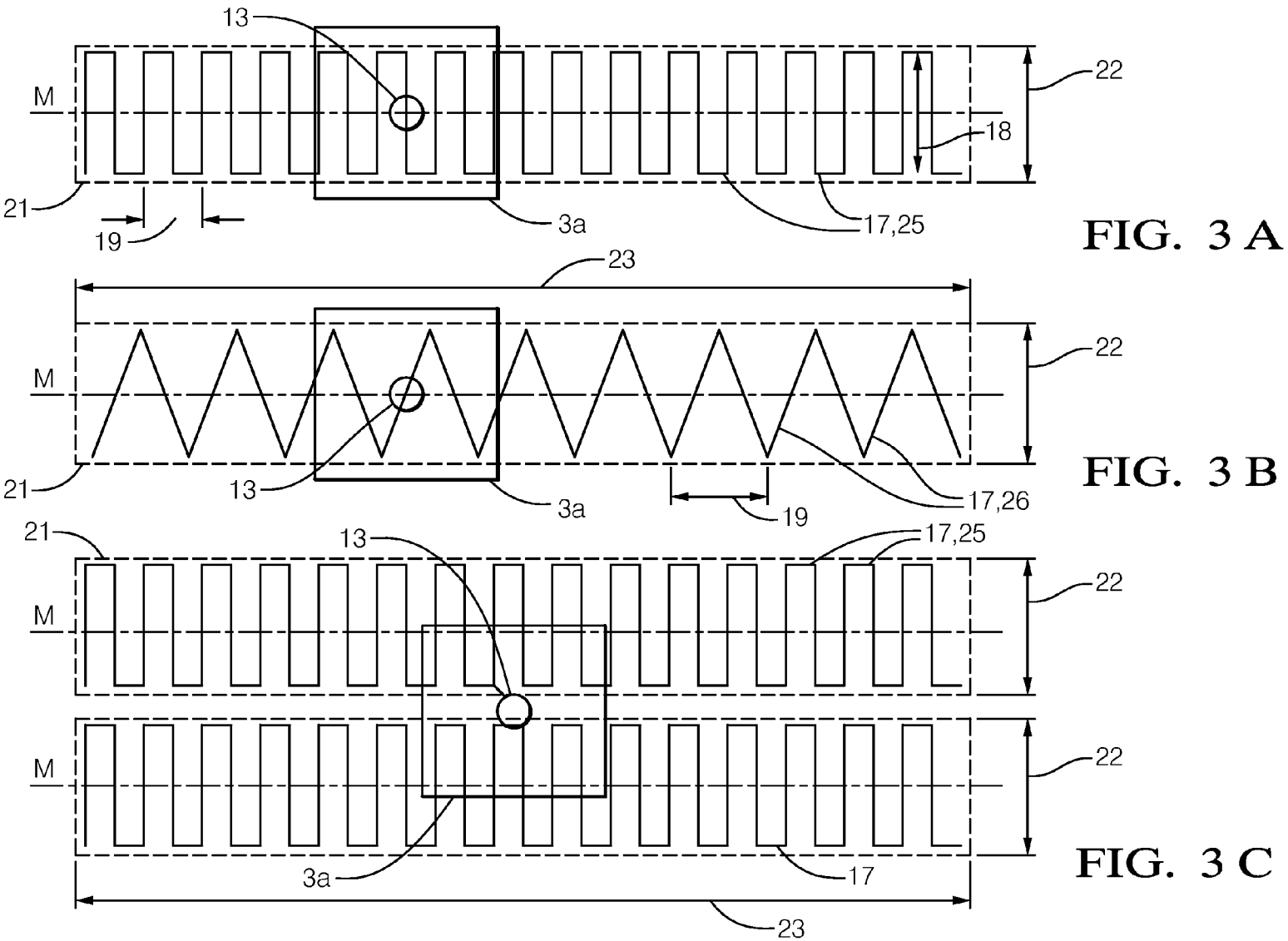

Like in FIG. 3*a*, however, the periodic conductor structure of the roof capacitor 8 is designed as a periodic triangular structure with the period 19 in accordance with the invention designed within the virtual strip 21.

FIG. 3*c*

For an increase of the roof capacitor 8 at least two substantially like periodic conductor structures which are arranged in parallel to one another with their longitudinal sides in virtual strips 21. The two periodic conductor structures are conductively connected to the upper end of the rod-shaped monopole 13.

FIG. 4*a* a) A plan view onto a multiband-receiving antenna 1 in accordance with the invention having a further satellite antenna 3*b* for a satellite radio service of lesser transmission frequency fs2 and a running conductive wave whose phase difference over a period likewise amounts to 2Π, the further satellite antenna extending concentric with respect to the first satellite antenna 3*a* having a running conductive wave whose phase difference over a period that amounts to specifically 2Π. For the exemplary design of a directional antenna settable in its main azimuthal direction a third satellite antenna 3*c* for the reception of the same satellite signal like that of the first satellite antenna 3*a* is present whose running conductive wave takes on the phase difference over a period of specifically 4Π. The settable main direction can be realized by the superposition of the signals of the first 3*a* and the third 3*c* satellite antenna via an antenna combiner settable in the combiner phase;

FIG. 4*b*

A roof capacitor 8 like in FIG. 3*b*. The periodic conductor structure, formed as a triangular structure, is, however, designed as a coil having a period 19 on a thin dielectric plate-shaped coil body 28 from the shape of the virtual strip 21.

FIG. 5

In comparison shows a roof capacitor 10 not in accordance with the invention which is designed as aerially conductive and the directional pattern of the satellite antenna 3 is influenced in an intolerable manner.

FIG. 6

The periodic conductor structure 24 of the roof capacitor 8 is designed as a meandering structure in such a way that the two shanks are respectively angled downwardly at both sides of the middle line M by an angle of inclination 16 with respect to the horizontally lying vertical strip 21. In this connection the dimensions of the meandering structure are selected such that their vertical projections onto the virtual strip 21 fill this and the angle of inclination 16 approximately takes on the value of 60°.

FIG. 7

Figure 6:
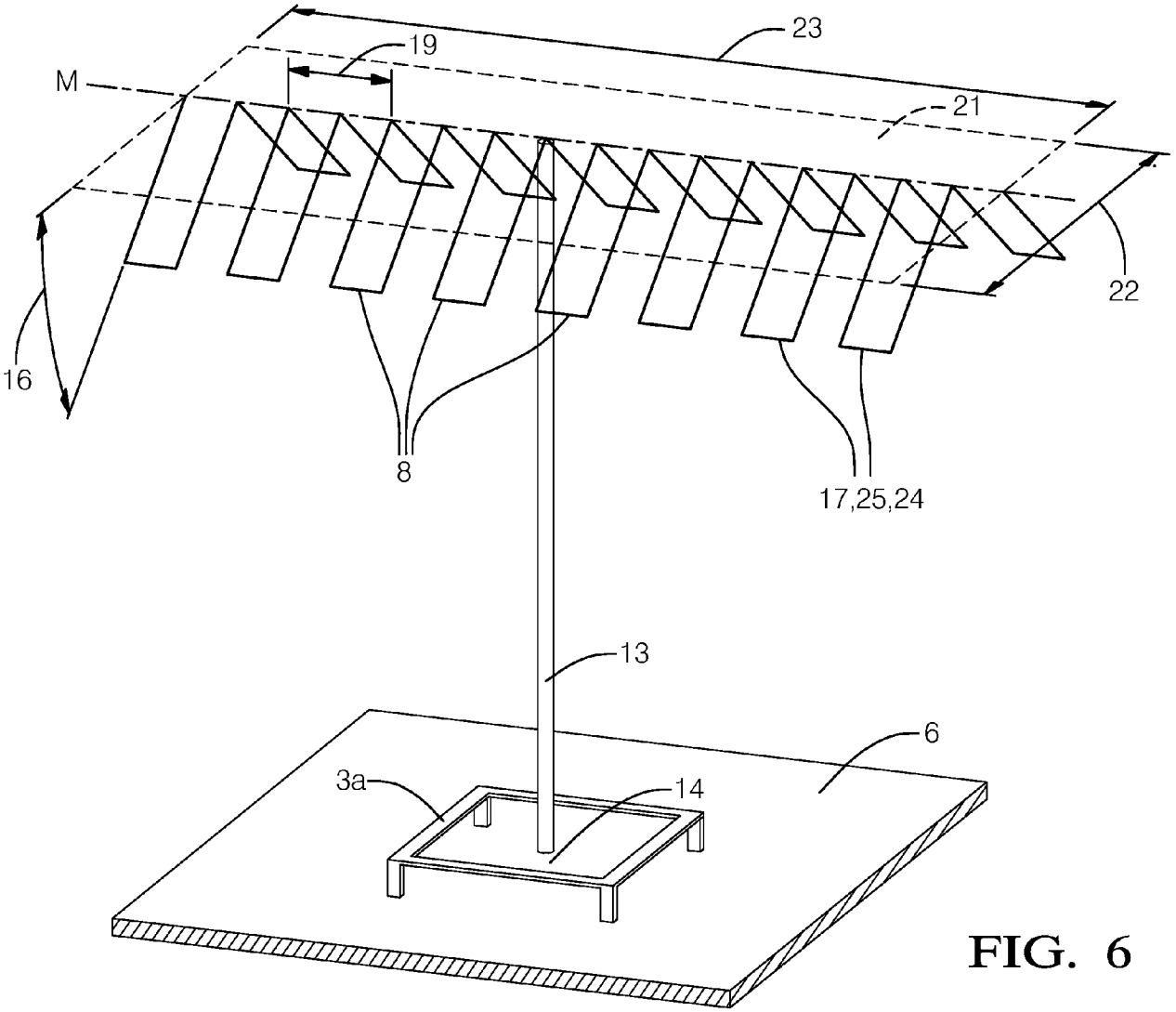

A multiband-receiving antenna in accordance with the invention like in FIG. 6, however, having a satellite receiving antenna 3*a* and having a phase difference over a period of 2Π and having a concentric satellite antenna 3*b* for the reception of a further satellite service at lower frequency, and/or selectively with a phase difference over a period 4Π at the same frequency as the satellite receiving antenna 3*a* for the combination of the satellite antenna connections 5*a* and 5*b* by a superposition of the receiving signals via a settable antenna phase combiner for the setting of the azimuthal main direction of the directional pattern.

FIG. 8*a*

A perspective illustration of a rod-shaped monopole having a roof capacitor 8 for an antenna in accordance with the invention with partial covering 30 of the coil 35 for an increase of the receiving voltage of the rod-shaped monopole in the VHF frequency range by means of a rod-shaped design of an electrically insulated omnidirectional rod 39 in its lower section for the capacitive coupling in at the wire coil with an electrically conductive round rod 38 with the monopole connection point 14.

(The satellite receiving antenna is not illustrated)

FIG. 8*b*

A longitudinal sectional illustration of a rod-shaped monopole having a roof capacitor 8 for an antenna in accordance with the invention with partial covering 30 of the coil 35 for an increase of the receiving voltage of the rod-shaped monopole in the VHF frequency range by means of a rod-shaped design of an electrically insulated omnidirectional rod 39 in its lower section for the capacitive coupling in at the wire coil with an electrically conductive round rod 38 with the monopole connection point 14.

(The satellite receiving antenna is not illustrated)

FIG. 9

Figures 8A, 8B:
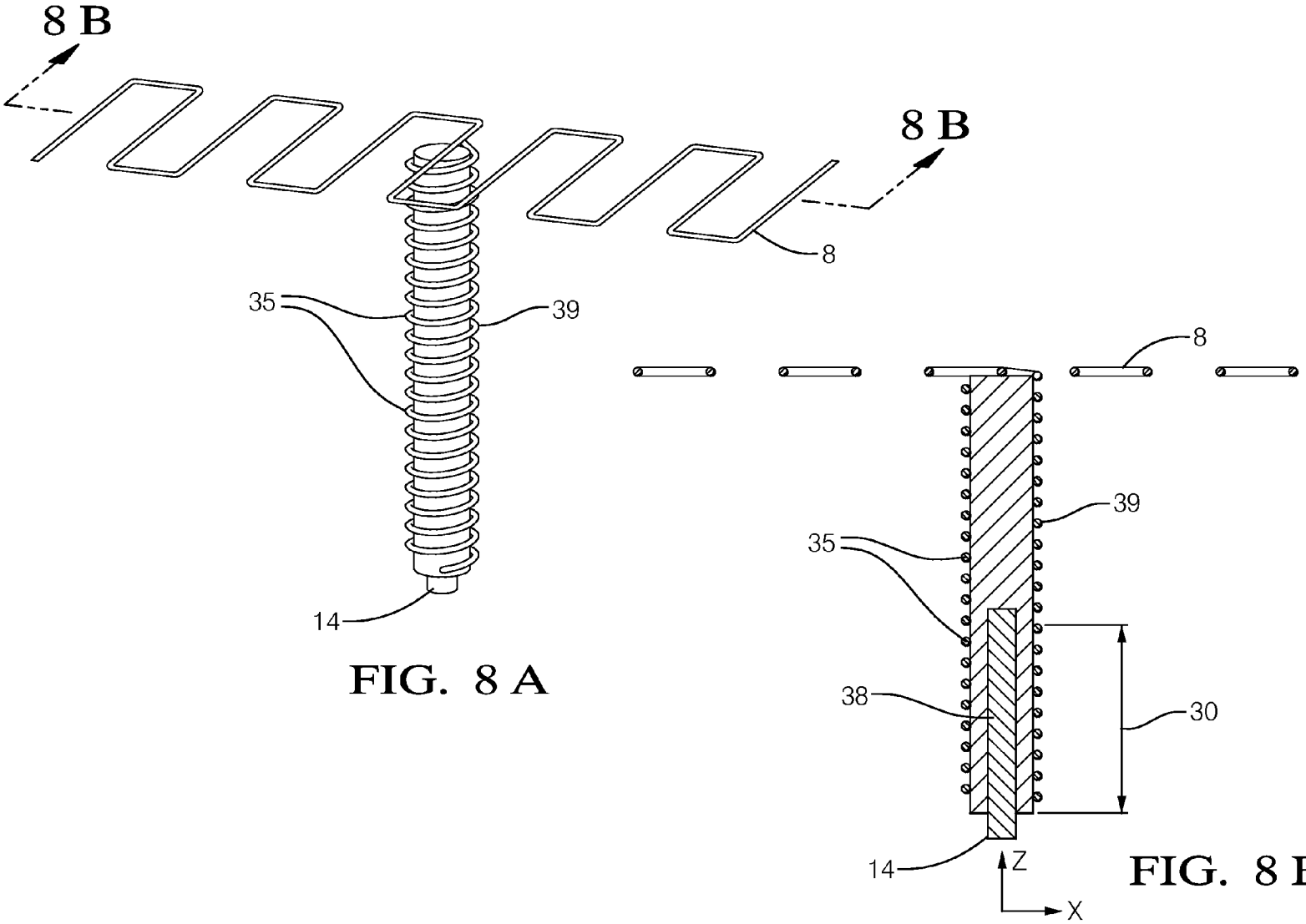

A rod-shaped monopole with roof capacitor 8 like in FIG. 8, however, with an electrically conductive socket 41 with an internal, electrically insulated plastic tube 40 for the mechanical form-fitted reception of the cylindrical coil 35 present at the electrically insulated round rod 39. The monopole ring conductor spacing 37 required at each position should preferably not undercut 15% of the inner ring conductive width 36.

DETAILED DESCRIPTION OF EMBODIMENTS OF THE INVENTION

The ring line radiator 2 of the satellite antenna 3 in accordance with the invention, at the bottom of FIG. 1, is exemplary designed as a passive resonant structure for a transmission or receiving antenna which enables the irradiation and/or the reception of substantially circularly polarized waves in an elevation angular range between theta=0° (vertical) and theta=65° and substantially vertically polarized waves in an elevation angular range between theta=90° and theta=85°, with theta describing the angle of the incident wave with respect to the vertical. In this respect omnidirectional radiation is generally aspired azimuthally. In this connection the transmission mode of the satellite receiving antenna is considered merely for the explanation of the antenna properties with reference to the reciprocal properties. The passive resonant structure can in this connection be designed for different modes.

The distribution of the currents at an antenna in the receiving operation is dependent on the terminal resistance at the antenna connection point 5. In contrast to this, the distribution of the currents with regard to the feed current at the antenna connection point 5 of the antenna conductors in the transmission operation is independent of the source resistance of the feeding signal source and is thus unambiguously associated with the directional pattern and the polarization of the antenna. FIG. 1 shows a satellite antenna 3 in accordance with the invention having a quadratic ring line radiator 2 for the generation of a circular polarized electromagnetic far field and designed as a resonant structure. The ring line radiator 2 is designed running in a horizontal plane at the height 9 over the conducting base surface 6, such that it forms an electric line with respect to the conductive base surface 6 having a wave resistance which results from the height and the effective diameter of the substantially wire-like ring line conductor. For generation of the desired circular polarization with an azimuthal dependent phase of a rotary direction of the transmission in the far field it is necessary in case of transmission to excite a conductive wave at the ring line radiator 2 the wave expanding exclusively in one direction.

For generating the resonance, the elongate length L of the ring line of the ring line radiator 2 is selected in such a way that it substantially amounts to a whole numbered multiple of the wavelength, wherein the wavelength is equal to the free space wavelength λs1. For W=whole numbered, this means for a complete wavelength at the ring structure, the following thus results for their elongated length substantially L=W*λs1.

For the satellite reception of an azimuthal omnidirectional pattern the simple resonance is to be selected as W=1. The elongate length L can then also be designed shorter than the free space wavelength λs1.

A central property of an antenna in accordance with the present invention is the possibility of manufacture which is low in demand in effort and cost. An advantageous shape of the antenna outstanding in this regard having a quadratic ring line radiator 2 is illustrated in their designs in the FIGS. 1 and 2. The ring line radiator 2 with the vertical radiators 4*a*, 4*b*, 4*c*, 4*d*, together with the aerial electrodes or the capacitive electrodes 32*a*, 32*b*, 32*c*, 32*d* individually formed at their lower ends, can be manufactured, for example, from a connected stamped and shaped sheet metal part. Also the wave resistance of the partial pieces of the ring line radiator 2 can be individually designed through a selection of the width of the connection pieces. The unidirectional effect of the electromagnetic excitation of the ring conductor 2, with respect to the wave formation as well as the impedance matching at the satellite antenna connection 5 can be achieved by the dimensioning of the capacitive electrodes 32*a*, 32*b*, 32*c*, as well as by the coupling in over the capacitive electrode 32*d* at the vertical radiator 4*d* in connection with the design of the wave resistance of the part pieces of the ring radiator.

The electrically conducting base surface 6 is preferably designed as a conductively coated circuit board. The coupling in at the vertical radiators, preferably realized as capacitors 15, is formed in such a manner that the capacitive electrodes 32*a*, 32*b*, 32*c*, 32*d* are designed at the electrically conducting base surface 6 for the coupling of three vertical radiators 4*a*, 4*b*, 4*c*. With regard to the design and the capacitive coupling of the fourth vertical radiator 4*d* at the antenna connection 5 this is designed as an insulated areal counter electrode 34 with regard to the conductive layer of the circuit board which counter electrode can be designed as a capacitive electrode 15*d* or as an electrode 15. Thus, in a manner particularly small in demand in effort and cost, the possibility exists to manufacture the dimensions essential for the function of the invention via a stamped and shaped sheet metal part having the advantages of high reproducibility. The sheet metal part and the electrically conductive base surface 6 designed as a circuit board can be connected, for example, by bonding in a way low in demand in effort and cost and thus without having to be brazed to another in a way demanding in effort and cost. The connection to a receiver can be realized in a manner known per se, for example, by connection of a micro-strip conductor or a coaxial conductor starting from the antenna connector 5.

In accordance with the invention the electromagnetic excitation of a ring line can also take place via the introduction of signals differing in phase from 90° at ring line coupling points 7 spaced apart from one another at $\lambda/4$.

The satellite antenna 3 in accordance with the invention is particularly robust with regard to the capability of being interfered with, with respect to its radiation diagram in comparison to other circularly polarized antennas. Together with the combination in accordance with the invention having the rod-shaped monopole present at its center and having a roof capacitor 8 designed in accordance with the invention, the invention also provides a solution at large strip lengths 23 which maintain the predetermined tolerance values of approximately 0.5 dB for satellite antennas.

The substantially periodic conductor structure 24 having the period 19 and the strip width 22 connected in a conductive manner to the upper end of the rod-shaped monopole 13 for the formation of its roof capacitor 8 which substantially periodic conductor structure is, for example, made of a wire-shaped conductor 17 and which expands substantially about a horizontally oriented longitudinal middle line M in an oscillating manner is generally transparent with respect to the incident electromagnetic waves from the satellite at the frequency fs1. In this connection it is advantageous that, through the meanderization and/or the periodic conductor structure, the static capacitor, which is required for the formation of the AM/FM antenna, is only marginally reduced by the wire-shaped design.

For a simple explanation of the position and the design of the different structures of the roof capacitor 8 an elongate virtual strip 21 is introduced which is substantially horizontally oriented with respect to its surface which has a longitudinal middle line M. The strip 21 has the strip length 23 and the strip width 22, with the substantially periodic conductor structure 24 substantially being designed running within the surface of this strip 21, such that in a plan view the substantially periodic conductor structure 24 having the oscillation width 18 is arranged within the boundary of the strip 22 and filling this substantially. Good results were achieved, e.g. for a multiband receiving antenna 1 for the frequency ranges AM, VHF and SDARS having a strip length 23 of approximately 12 cm, a strip width 22=the oscillation width 18 of approximately 2.5 cm and a period 19 of 1 cm at an antenna constructional height 29 of approximately 7 cm.

Figure 5:
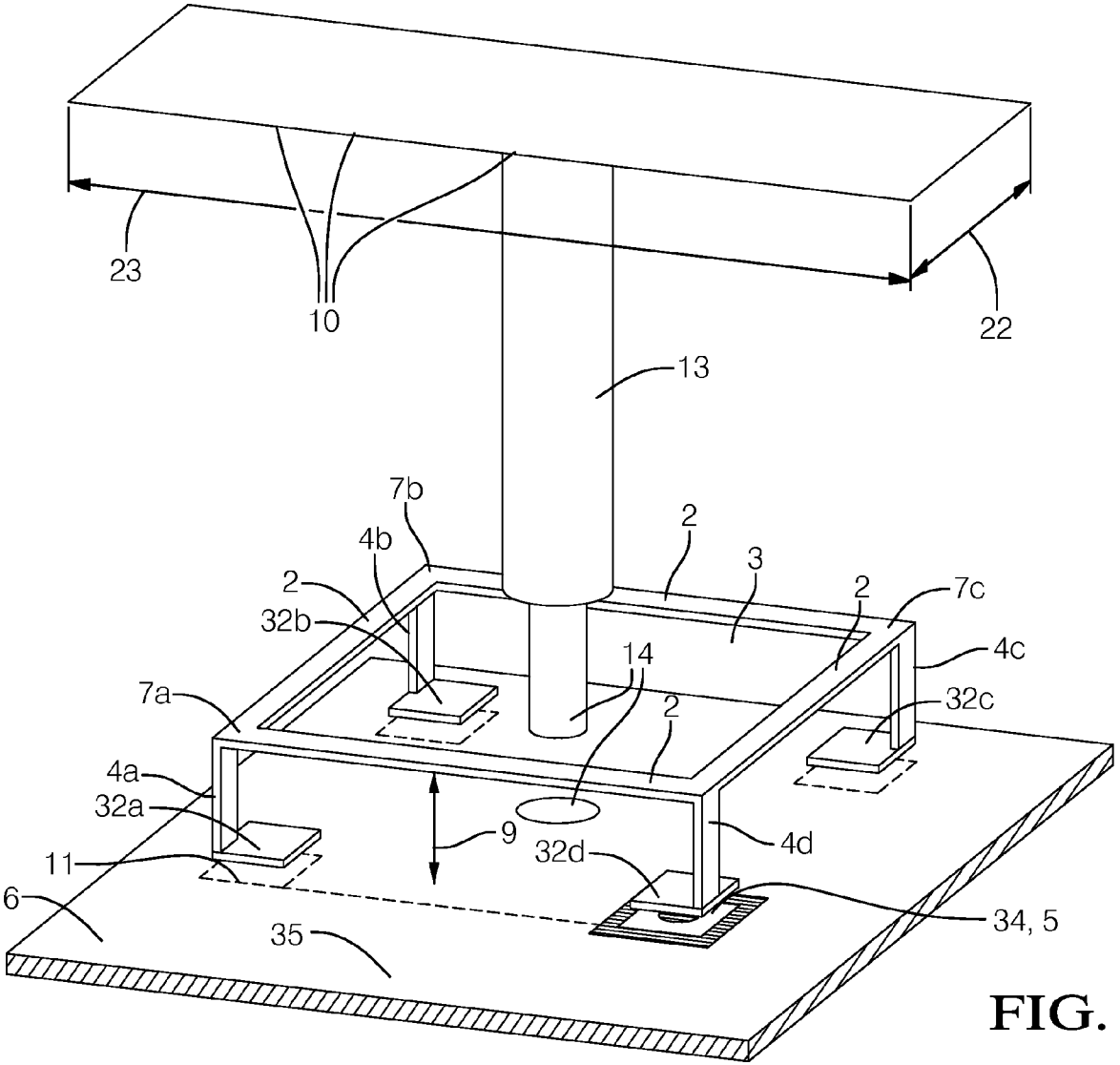

If one were to deviate from a roof capacitor 8 in accordance with the invention and design this aerially conducting, as is illustrated in FIG. 5, then, in particular for an azimuthal incidence of electromagnetic waves perpendicular to the longitudinal middle line M, an intolerable deformation of the azimuthal directional pattern were to result. The roof capacitor 8 in accordance with the invention having a substantially periodic conductor structure 24 expanding in an oscillating manner about the longitudinal middle line M solves this problem. For this reason the strip width 22 should be selected sufficiently small in accordance with the invention. For a strip length 23 which is at least three times as large as the strip width 22 particularly small influences on the directional pattern of the satellite antenna result in an advantageous embodiment of the invention when the strip width 22 is not larger than ⅜ space wavelength λs1 and the period 19 is not larger than ¼ of the free space wavelength λs1 of that satellite radio service having the highest frequency fs1. In the interest of an as small as possible strip width 22 it is advantageous in accordance with the invention to arrange at least two substantially like periodic conductor structures in virtual strips for the increase of a roof capacitor 8, as is illustrated in FIG. 3*c*, the virtual strips being guided in parallel to one another with respect to their longitudinal sides at a small spacing and to connect the at least two periodic conductor structures 24 conductively to the upper end of the rod-shaped monopole 13.

In an advantageous embodiment of the invention, in analogy to a meandering structure 25, the periodic conductor structure 24 of the roof capacitor 8 can be designed as a substantially periodic triangular structure having the period 19, which triangular structure substantially completely fills the virtual strip 21, wherein the strip length 23 can amount to approximately 0.8 times the free space wavelength λs1 and the strip width 22 can amount to approximately 0.15 times the free space wavelength λs1 and the rod-shaped monopole 13 can be conductively connected to the periodic conductor structure 24 approximately at the center of the virtual strip 21. In a similar illustration the periodic conductor structure 24 designed as a triangular structure, as illustrated in FIG. 4*b*, can be designed as a coil, for example, of a wire or of a conductive track having the period 19 on a dielectric plate-shape coil body 28 of the shape of the virtual strip 21.

Figure 2:
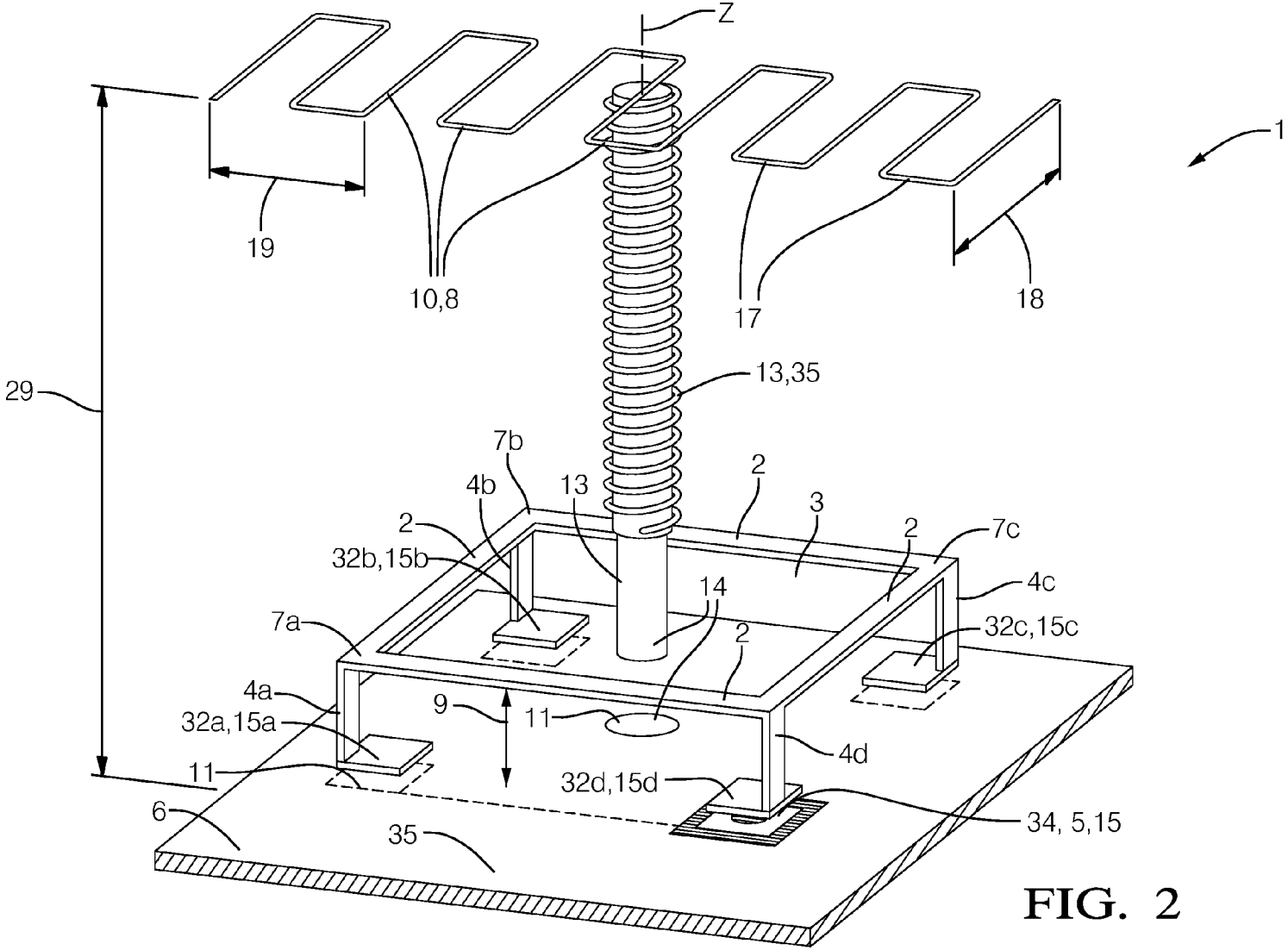

In an exemplary, particularly cheap practical design of a multiband-receiving antenna 1 for the satellite radio service SDARS at the frequency fs1 of approximately 2.3 GHz and a free space wavelength λs1=13 cm the periodic conductor structure 24 of the roof capacitor 8 is designed as a substantially periodic meandering structure having the period 19. This substantially completely fills the virtual strip 21, wherein the strip length 23 can amount to approximately 0.8 times the free space wavelength λs1 and the strip width 22 can amount to approximately 0.15 times the free space wavelength λs1 and the rod-shaped monopole 13 can be connected to the periodic conductor structure 24 in a conducting manner approximately at the center of the virtual strip 21. The height of the rod-shaped monopole 13 which determines the overall height of the multiband-receiving antenna 1 can in this connection amount to approximately half of the free space wavelength λs1. For generating a resonance in the vicinity of the FM frequency band, the rod-shaped monopole 13 is designed as a substantially cylindrical wire coil 35, as is illustrated in FIG. 2, which is wound onto a round-shaped dielectric body for an increase of its self-inductance.

If, in the construction of vehicles, the requirement is added according to which the transverse dimension of the antenna is subjected to narrow constraints, then the periodic conductor structure 24 of the roof capacitor 8 can be designed, as illustrated in FIG. 5, as a meandering structure in such a manner that both shanks of the meander are angled downwardly at both sides of the middle line M respectively by the angle of inclination 16 with respect to the horizontally lying virtual strip 21 and the dimensions of the meandering structure are selected such that their vertical projection onto the virtual strip 21 fills this and such that the angle of inclination 16 approximately takes on the value of 60°.

Figure 4A:
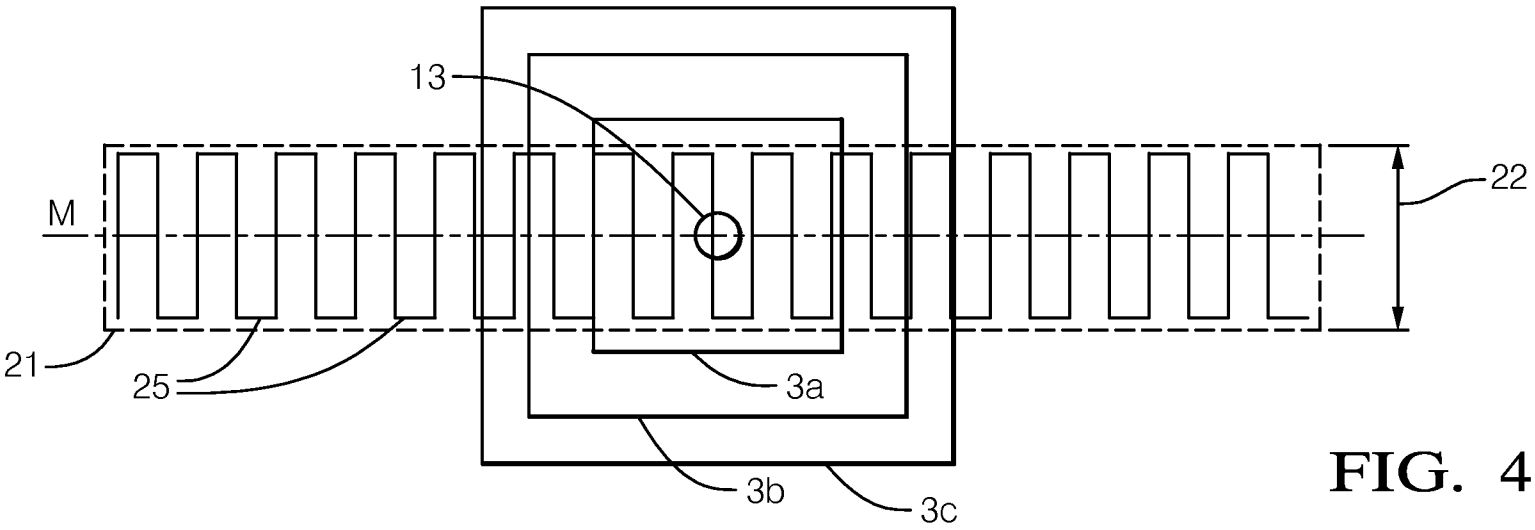
Figure 4B:
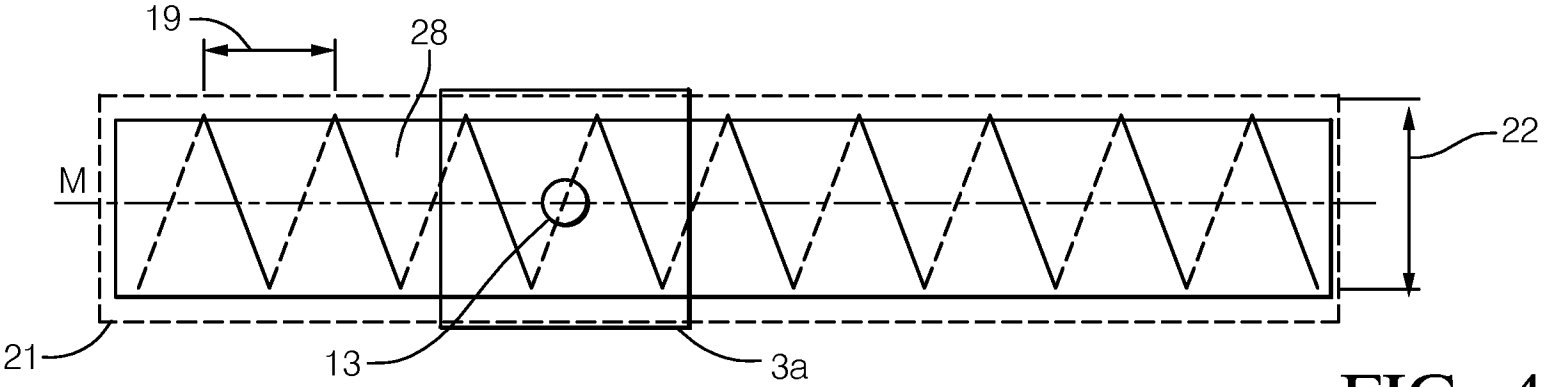
Figure 7:
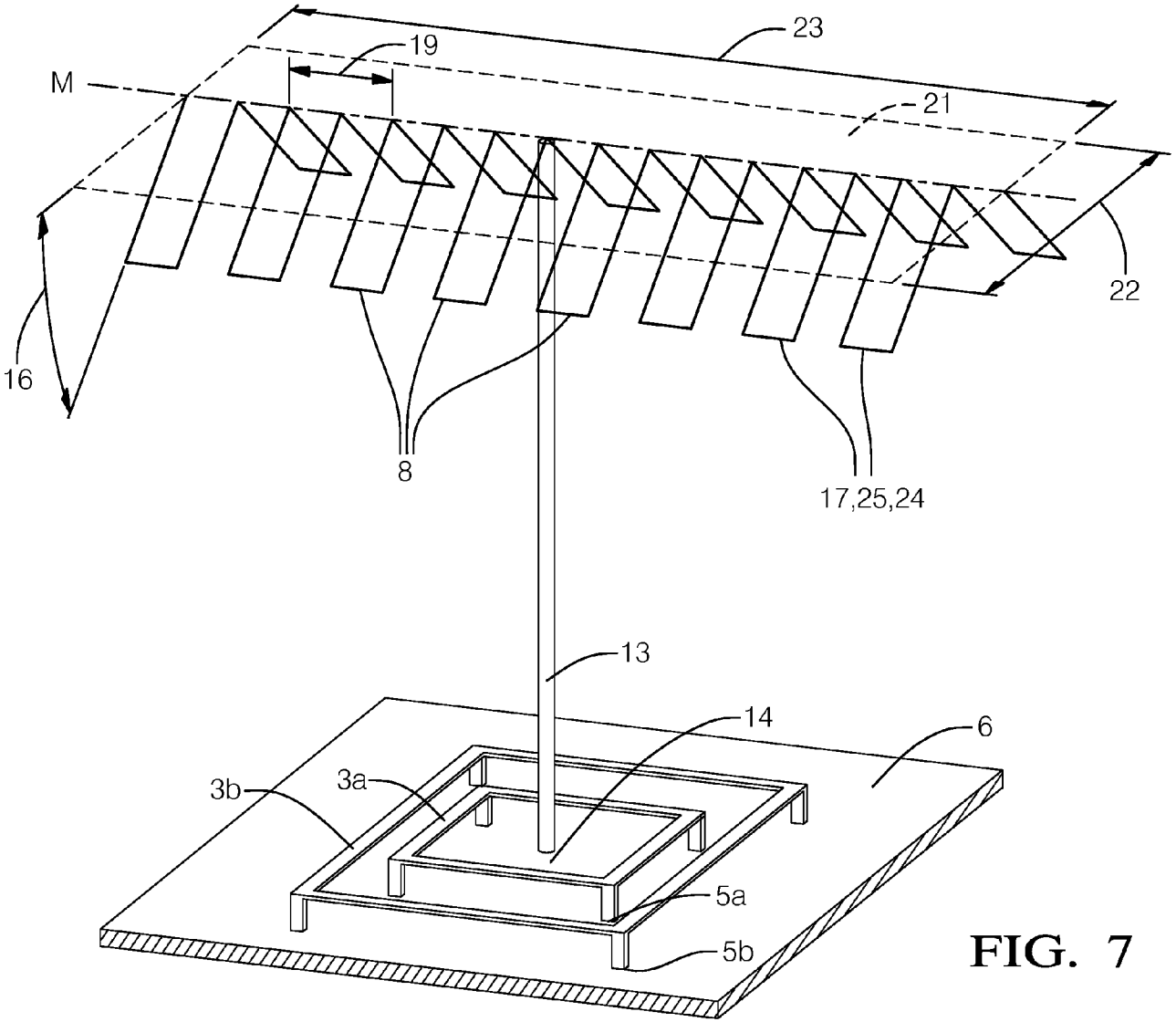

FIG. 4*a* shows the plan view and FIG. 7 shows a perspective view onto a multiband-receiving antenna 1 in accordance with the invention with a plurality of satellite antennas concentrically oriented with respect to one another. Exemplary it is presupposed in this connection that the innermost satellite antenna 3*a* is operated at resonance with the frequency fs1 with a running conductive wave at a frequency fs1 whose phase difference over a period amounts to exactly 2Π as is, e.g. suitable for the azimuthal omnidirectional reception of SDARS radio broadcast signals. A further satellite antenna 3*b* for a satellite radio service having a lower transmission frequency fs2 and a running conductive wave whose phase difference over a period likewise specifically amounts to 2Π is, for example, suitable for the reception of GPS signals.

A further satellite antenna 3*b* for the reception of the same satellite signal is arranged concentric to the first (innermost) satellite antenna 3*a* having a running conductive wave whose phase difference over a period amounts to specifically 2Π is illustrated in the FIGS. 4*a* and 7, said further satellite antenna 3*b*, however, having a running conductive wave whose phase difference over a period amounts to specifically 4Π. On a combination of the satellite antenna connections 5*a* and 5*b*, through a superposition of the received signals of the two satellite antennas 3*a*, 3*b* via an antenna combiner having a settable combiner phase, to a common directional antenna connection, a satellite directional antenna settable in its main azimuthal direction results through the setting of the combiner phase. If one supplements the multiband-receiving antenna by a third satellite antenna 3*c*, as is sketched in FIG. 4*a*, then this can be used, e.g. additionally for the reception of a further satellite service at a different frequency, such as for example for the reception of GPS signals.

These examples particularly distinctively show the versatile design capabilities of the multiband-receiving antenna for a series of satellite radio services SDARS, GPS etc. in connection with terrestrial radio services, such as for example, AM/FM, DAB in the VHF band and in the L band which can be considered by the specific design of the rod-shaped monopole 13. In particular on the design of a low construction height 29 of the antenna in accordance with the invention it is shown as being particularly advantageous to design the vertical radiator 4 in accordance with the specifications detailed in the DE 102009037722 A1. For a constructional height 29 of 15 cm and smaller it is provided there to capacitively cover the coil 35 applied at the electrically insulated round rod 39 of the monopole 13—in FIG. 8 covering 30—for an increase of the receiving voltage of the antenna rod in the VHF frequency range over a suitable length. This is, applied to an antenna in accordance with the invention, exemplary illustrated in a perspective view in the FIG. 8 and in a longitudinal section in FIG. 8*b*. There the electrically insulated round rod 39 is designed as a plastic rod which is of tubular design in its lower section. For the capacitive coupling in at the coil an electrically conducting round rod 38 is introduced into the tubular opening, whose lower end forms the monopole connection point 14. In an advantageous manner, with the aid of capacitive coupling, the galvanic connection of the coil to the monopole connection point 14 demanding in effort and cost from a machining aspect can be avoided in this connection.

The increase of the receiving voltage at the monopole connection point 14 in the VHF frequency range can be particularly advantageously utilized by the above-described measure when the monopole connection point 14 is equipped with an antenna circuit directly downstream thereof, having high impedance active elements, such as for example, field effect transistors with a small input capacitance. Such circuits are, for example, described in the EP 1 246 294 A3 and in the EP 1 406 349 A3.

Figure 9:
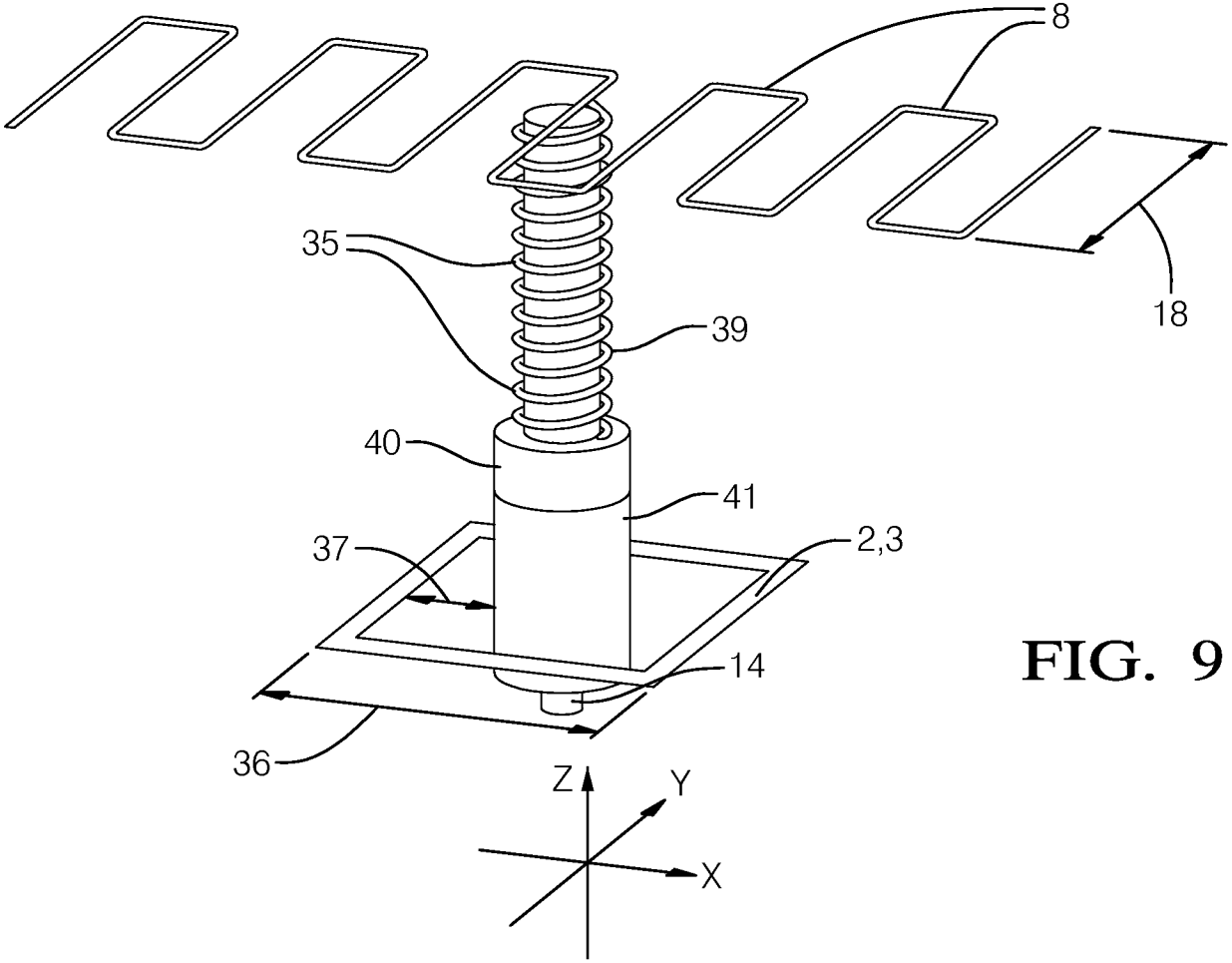

In a similar manner the capacitive connection of the conductor coil or of the wire coil to the monopole connection point 14 can take place with the aid of an electrically conducting socket 41 in an advantageous manner which socket is cladded in its interior with a plastic tube 40. Into this the cylindrical coil 35 present at the electrically insulating omnidirectional rod 39 is mechanically introduced in a form-fitted manner and the covering 30 is produced in this manner. FIG. 9 shows the rod-shaped monopole 13 with a meandering shaped roof capacitor 8 in accordance with the invention, the electrically insulating plastic tube 40 and the electrically conducting socket 41 at whose lower end the monopole connection point 14 is formed.

In order to not notably interfere with the current distribution at the ring conductor of the satellite antenna 3 by means of the rod-shaped monopole 13 present in its center, it is advantageous to maintain a minimum value for the monopole ring line spacing 37—as is illustrated in FIG. 9. If one defines the narrow spacing respectively present between two azimuthal points lying opposite one another at the inner boundary of the ring conductor as the inner ring conductor width 36 and the spacing between one of such points at the inner boundary of the ring conductor and the next closest lying point thereto at an electric conductor of the rod-shaped monopole 13 as the monopole ring conductor spacing 37, then this monopole ring conductor spacing 37 should not undercut the value of approximately 15% of the associated inner ring conductor width 36, at this position. This spacing should be maintained for all azimuthal directions of the xy-plane of the ring conductor and for all spatial points x, y, z at the rod-shaped monopole 13. In particular for satellite antennas for very high frequencies and with small inner ring conductor width 36 it is therefore advantageous to design the rod-shaped monopole 13 at its lower end, as is illustrated in the FIGS. 8*a* and 8*b*, with a correspondingly slender electrically conducting round rod 38 for the secure maintenance of the required minimum value for the monopole ring conductor spacing 37.

For the vertically polarized signals of the terrestrial radio broadcasting services of higher frequencies, such as e.g. GSM 900, GSM 1800, UMTS and DAB L band it is advantageous in accordance with the invention to design the lower part of the vertical radiator 4 as an electrically conductive round rod 38 corresponding to the resonant length of, for example a quarter wavelength of one of the said radio services and to design the wire coil 35 attached at the rod-shaped dielectric body of the monopole 13 in the upper part of the rod-shaped monopole 13 in such a manner that in the VHF frequency range in connection with the meander-shaped roof capacitor the above-described VHF resonance is set. Additionally, through a corresponding design of the wire coil 35, resonances also can be realized for the frequencies for a plurality of the above said radio services of higher frequency. A combination of the measures can take place in an advantageous manner in that the electrically conductive rod 38 is designed for the radio service with the lowest frequency and the wire coil 35 includes a plurality of wound coil packages wound with different densities and spaced apart from one another at the electrically conducting rod 38 in the upper part. These each bring about a blocking of signals of higher frequencies with respect to the part of the monopole present there above. The monopole can thus be designed in such a way that it is multi-resonant, such that for the different wavelengths of the radio broadcast service frequencies, corresponding long radiators are active with corresponding resonant impedances at the monopole connection point 14. All inductivities brought about by the complete coil 35 in cooperation with the meander-shaped roof capacitor 8 form the resonance in the range of the VHF frequency, whereby the rod-shaped monopole 13 together with the concentric satellite antennas 3*a* and 3*b* can form a multiband-receiving antenna in accordance with the invention, for example, for the six broadcast services AM, FM, DAB VHF, DAB L and the satellite radio services SDARS and GPS.

LIST OF REFERENCE NUMERALS

Multiband-receiving antenna 1
Ring line radiator 2
First satellite receiving antenna 3*a*
Second satellite receiving antenna 3*b*
Vertical radiator 4, 4*a*, 4*b*, 4*c*, 4*d*, 4*e*
Satellite antenna connection 5, 5*a*, 5*b*
Conducting base surface 6
Ring line coupling point 7, 7*a*, 7*b*, 7*c*, 7*d*
Meander-shaped roof capacitor 8
Spacing (height) 9
Areal roof capacitor 10
Ground connection point 11
Rod-shaped monopole 13
Monopole connection point 14
Electrodes 15, 15*a*, 15*b*, 15*c*, 15*d*
Angle of inclination 16
Wire-shaped conductor 17
Oscillation width 18
Period 19
Lower rod end 20
Virtual strip 21
Strip width 22
Strip length 23
Periodic conductor structure 24
Meandering structure 25
Triangular structure 26
Oscillating conductor structure 27
Plate-shaped coil body 28
Antenna construction height 29
Covering 30
Capacitive electrode 32*a*, 32*b*, 32*c*, 32*d*
Coil 35
Inner ring line width 36
Monopole ring line spacing 37
Electrically conducting round rod 38
Electrically insulating round rod 39
Plastic tube 40
Electrically conductive socket 41
Elongate length of the ring line radiator L
Central line Z
Longitudinal middle line M
λs1 free space wavelength of the first satellite radio service
fs1 transmission frequency of the $1^{st}$ satellite radio service (highest frequency)

What is claimed:

1. A multiband receiving antenna for the combined reception of circularly polarized satellite radio signals of at least one satellite radio service transmitting in a circularly polarized manner and of terrestrially transmitted radio broadcasting signals via a substantially horizontally conducting base surface as a ground, said multiband receiving antenna comprising:

at least one satellite receiving antenna having a satellite antenna connection, the at least one satellite receiving antenna being associated with at least one satellite radio service having the transmission frequency fs1 and the free space wavelength λs1; and a monopole antenna having a specific monopole connection point, the monopole antenna receiving a terrestrial, radio broadcast signal transmitted in a linearly polarized manner, wherein, said at least one satellite receiving antenna includes a ring line radiator which is rotationally symmetric with respect to its center Z, which ring line radiator is configured as a ring guide that is polygonal or circular and that is mechanically closed, the ring guide having the extended length L running in a plane parallel with respect to the conducting base surface over the conducting base surface and having the height smaller than λs1/8, a plurality of (N) vertical radiators are connected via ring line connection points to the ring line radiator over the circumference of the length (L) of the ring line radiator of the satellite receiving antenna in equal length extended length spacings (L/N) of the structure separate from one another, the ring line radiator is excited via at least one of the vertical radiators between whose lower end and the conducting base surface the satellite antenna connection is formed, with the at least one satellite receiving antenna being circularly polarized, the remaining vertical radiators are respectively connected at their lower ends at a ground connection point to the conducting base surface via a respective capacitor, the monopole antenna includes a substantially rod-shaped monopole oriented vertical with respect to the conducting base surface and extending through the center Z of the ring line radiator, the monopole connection point being formed at the lower end of the rod-shaped monopole together with the conducting base surface for the decoupling of the radio broadcast signals transmitted in a linearly polarized manner, a substantially periodic conductor structure is conductively connected to the upper end of the rod-shaped monopole for forming its roof capacitor, said periodic conductor structure being formed from a conductor having a period and an oscillation width and expanding in an oscillating manner about a substantially horizontally oriented longitudinal middle line (M), and both the period and the oscillation width are each selected smaller than half the free space wavelength λs1 of said satellite radio service having the transmission frequency fs1.

2. The multiband receiving antenna with of claim 1, wherein the middle line of an elongate virtual strip having the strip length and the strip width is provided by the longitudinal middle line M, said strip being oriented substantially horizontal with respect to its surface, and, wherein the substantially periodic conductor structure is formed running substantially in the surface of this strip such that, in a plan view, the substantially periodic conductor structure having the oscillation width is arranged within the border of the strip and substantially fills it.

3. The multiband receiving antenna of claim 2, wherein the strip length is selected at least three times as large as the strip width and in that the strip width is not selected larger than ⅜ of the free space wavelength λs1 and the period is not selected larger than a ¼ of the free space wavelength λs1 of said satellite radio service having the highest frequency fs1.

4. The multiband receiving antenna of claim 1, wherein the periodic conductor structure of the roof capacitor is designed as a substantially periodic meandering structure having the period which structure substantially completely fills a virtual strip, wherein the strip length can amount to approximately 0.8 of the free space wavelength λs1 and the strip width can amount to approximately 0.15 of the free space wavelength λs1 and the rod-shaped monopole is conductively connected to the periodic conductor structure approximately at the center of the virtual strip.

5. The multiband receiving antenna of claim 1, wherein the periodic conductor structure of the roof capacitor is designed as a meandering structure, wherein a respective shank of the meandering structure is angled downwardly at both sides of the longitudinal middle line M respectively about an angle of inclination with respect to the horizontally lying virtual strip and the dimensions of the meandering structure are selected such that their vertical projection onto the virtual strip fills this, wherein the angle of inclination in particular approximately takes on the value of 60°.

6. The multiband receiving antenna of claim 1, wherein, for the increase of the roof capacitor, at least two substantially like periodic conductor structures are arranged at a small spacing from one another with their longitudinal sides in parallel to one another in a virtual strip and the at least two periodic conductor structures are conductively connected to the upper end of the rod-shaped monopole.

7. The multiband receiving antenna of claim 1, wherein the periodic conductor structure of the roof capacitor is designed as a substantially periodic triangular structure having the period which substantially completely fills a virtual strip, wherein the strip length can amount to approximately 0.8 of the free space wavelength λs1 and the strip width can amount to approximately 0.15 of the free space wave-length λs1 and the rod-shaped monopole is conductively connected to the periodic conductor structure approximately at the middle of the virtual strip.

8. The multiband receiving antenna of claim 1, wherein the periodic conductor structure designed as a triangular structure is configured as a coil having the period on a dielectric plate-shaped coil body in the shape of a strip.

9. The multiband receiving antenna of claim 1, wherein the rod-shaped monopole is provided by a substantially cylindrical coil for the increase of its self-inductance, which cylindrical coil is wound onto a rod-shaped dielectric body.

10. The multiband receiving antenna of claim 1, wherein the satellite antenna connection is not formed between the lower end of a vertical radiator and the conducting base surface and in that the remaining vertical radiators are respectively not connected at a ground connection point to the conducting base surface at their lower ends via a capacitor, but rather a distribution and phase network is present at the conducting base surface, which distribution and phase network is connected to the satellite antenna connection at the input side, wherein the vertical radiators are each excited with corresponding phases via one of the outputs of the distribution and phase networks such that a running electromagnetic wave is set at the ring line radiator in such a way that the circular polarization of the satellite receiving antenna is provided.

11. The multiband receiving antenna of claim 1, wherein the capacitors differing in their capacitor values are formed in that the vertical radiators are formed at their lower ends as individually designed areal capacitive electrodes and the capacitors are designed for the coupling of three vertical radiators to the electrically conducting base surface and, for the capacitive coupling of the fourth vertical radiator at the antenna connection, the latter is formed as an insulated, areal counter electrode of the conducting base surface.

12. The multiband receiving antenna of claim 1, wherein at least one further satellite antenna is present for a respective satellite radio service each having a lower transmission frequency fs2 and/or fs3 (and thus fs3 is smaller than fs2) and each having a running wave whose phase difference over a period likewise each amount to specifically 2Π, said at least one further satellite antenna being concentric to the at least one satellite antenna having a running conductive wave whose phase difference over a period amounts to specifically 2Π and the satellite antennas are designed in particular in accordance with the upper claims.

13. The multiband receiving antenna of claim 1, wherein a further satellite antenna is present for the reception of the same satellite signal, however, having a running wave whose phase difference over a period amounts to specifically 4Π, said further satellite antenna being concentric to the at least one satellite antenna having a running conductive wave whose phase difference over a period amounts to specifically 2Π and the satellite antenna connections are combined into a common directional antenna connection for a superposition of received signals of both satellite antennas via an antenna combiner having a settable combiner phase such that, by setting the combiner phase, a directional antenna is given settable in its main azimuthal direction.

14. The multiband receiving antenna of claim 1, wherein for one of the terrestrial radio services having vertically polarized signals of higher frequencies—such as e.g. GSM900, GSM1800, UMTS and DAB L band—the lower part of the monopole antenna is designed as an electrically conductive rod corresponding to the resonant length of a quarter wavelength of the concerned radio service and the monopole antenna is configured in its upper part with a coil in such a manner that in the VHF frequency range a resonance is given in connection with the meander-shaped roof capacitor.

15. The multiband receiving antenna of claim 14, wherein the monopole antenna is designed for a plurality of the said terrestrial radio services and the electrically conductive rod is dimensioned for the terrestrial radio service having the highest frequency and the coil following to the electrically conductive rod has a plurality of differently densely wound coil packages spaced apart in the upper part of the monopole antenna for the separation of signals of respectively higher frequencies with respect to the part of the monopole antenna respectively present there above such that, for the different wavelengths of the radio service frequencies, correspondingly long radiators are effective with corresponding resonant impedances at the monopole connection point.

16. The multiband receiving antenna of claim 1, wherein said conductor of said periodic conductor structure forms at least one of a triangular wave shape and a rectangular wave shape.

* * * * *